US009503821B2

(12) United States Patent
Atkins et al.

(10) Patent No.: US 9,503,821 B2
(45) Date of Patent: Nov. 22, 2016

(54) ELECTROSTATIC TRANSDUCER

(75) Inventors: Brian Atkins, Monmouth Gwent (GB); Duncan Billson, Warwickshire (GB); David Hoare, Herefordshire (GB)

(73) Assignee: Warwick Audio Technologies Limited, West Midlands (GB)

( * ) Notice: Subject to any disclaimer, the term of this patent is extended or adjusted under 35 U.S.C. 154(b) by 397 days.

(21) Appl. No.: 14/118,761

(22) PCT Filed: May 18, 2012

(86) PCT No.: PCT/GB2012/051130

§ 371 (c)(1),
(2), (4) Date: May 9, 2014

(87) PCT Pub. No.: WO2012/156753

PCT Pub. Date: Nov. 22, 2012

(65) Prior Publication Data

US 2014/0232236 A1 Aug. 21, 2014

(30) Foreign Application Priority Data

May 19, 2011 (GB) ..... 1108373

(51) Int. Cl.
*H04R 25/00* (2006.01)
*H04R 19/02* (2006.01)
(Continued)

(52) U.S. Cl.
CPC ..... *H04R 19/02* (2013.01); *H04R 7/08* (2013.01); *H04R 19/04* (2013.01); *H04R 23/006* (2013.01); *H04R 2201/003* (2013.01)

(58) Field of Classification Search
CPC ..... H04R 7/08; H04R 19/00; H04R 19/01; H04R 19/016; H04R 19/02; H04R
(Continued)

(56) References Cited

U.S. PATENT DOCUMENTS 2,975,243 A 3/1961 Katella
3,895,193 A 7/1975 Bobb
(Continued)

FOREIGN PATENT DOCUMENTS

CA 2195442 2/1996
GB 228 176 7/1926
(Continued)

OTHER PUBLICATIONS

International Search Report and Written Opinion prepared by the European Patent Office in International Application Serial No. PCT/GB2012/051130, mailed Nov. 5, 2012.
(Continued)

*Primary Examiner* — Huyen D Le
(74) *Attorney, Agent, or Firm* — McDonnell Boehnen Hulbert & Berghoff LLP

(57) ABSTRACT

An electrostatic transducer comprises an electrically conductive first layer (1), a flexible insulating second layer (25) disposed over the first layer, and a flexible electrically conductive third layer (26) disposed over the second layer. Between the first and the second layers are provided spacers (24) and between the second and the third layers are provided spacers (27). The spacers may be provided by strips of adhesive or by bonding the layers together by welding, for example. The first layer (1) is provided with an array of through apertures (5) each having an inlet (6) facing the second layer (2) and an outlet (7). In response to signals applied to the first and third layers, the second and third layers have portions which are displaced towards the outlets of the apertures by electrostatic forces. The apertures (5) may have conducting walls and the walls may converge.

18 Claims, 4 Drawing Sheets

(51) Int. Cl.
*H04R 23/00* (2006.01)
*H04R 19/04* (2006.01)
*H04R 7/08* (2006.01)

(58) Field of Classification Search
CPC ..... 19/04;H04R 23/006; H04R 2201/003; H04R 19/005; H04R 19/013
USPC ..... 381/113, 116, 174, 175, 190, 191; 29/25.41, 25.42, 594; 367/170, 181, 367/189
See application file for complete search history.

(56) References Cited

U.S. PATENT DOCUMENTS

| | | | | |
|---|---|---|---|---|
| 3,908,098 | A * | 9/1975 | Kawakami | H04R 19/00 367/189 |
| 3,935,397 | A | 1/1976 | West | |
| 3,942,029 | A * | 3/1976 | Kawakami | H04R 19/01 307/400 |
| 3,992,585 | A | 11/1976 | Turner et al. | |
| 4,533,794 | A | 8/1985 | Beveridge | |
| 5,161,128 | A | 11/1992 | Kenney | |
| 5,471,540 | A | 11/1995 | Maeda | |
| 6,044,160 | A * | 3/2000 | Norris | B06B 1/0292 381/116 |
| 6,628,791 | B1 | 9/2003 | Bank et al. | |
| 7,076,070 | B2 | 7/2006 | Pearce et al. | |
| 2002/0141606 | A1 | 10/2002 | Schweder et al. | |
| 2006/0208609 | A1 | 9/2006 | Heim | |
| 2007/0121970 | A1 | 5/2007 | Miyazaki | |
| 2007/0124620 | A1 | 5/2007 | Miyazaki | |
| 2007/0189559 | A1 | 8/2007 | Haan et al. | |
| 2009/0041266 | A1 | 2/2009 | Guo et al. | |
| 2009/0304212 | A1 | 12/2009 | Han et al. | |

FOREIGN PATENT DOCUMENTS

| | | |
|---|---|---|
| GB | 2413027 | 10/2005 |
| JP | 60 046196 | 3/1985 |
| JP | 2009-100438 | 5/2009 |
| JP | 2009 153056 | 7/2009 |
| JP | 2009-284397 | 12/2009 |
| WO | WO 93/01691 | 1/1993 |
| WO | WO 98/35529 | 8/1998 |
| WO | WO 02/19764 | 3/2002 |

OTHER PUBLICATIONS

International Search Report and Written Opinion prepared by the European Patent Office in International Application Serial No. PCT/GB2012/051132, mailed Oct. 22, 2012.
Search Report prepared by the Intellectual Property Office in Great Britain Application Serial No. GB1108371.4, dated Sep. 15, 2011.
Search Report prepared by the Intellectual Property Office in Great Britain Application Serial No. GB1108373.0, dated Jun. 9, 2011.

* cited by examiner

Figure 1
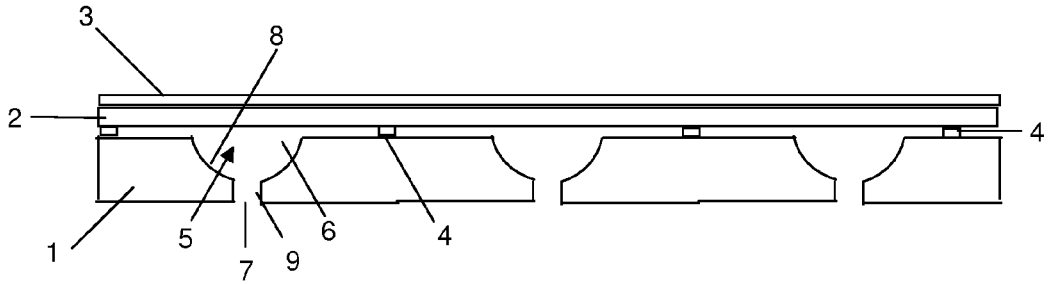
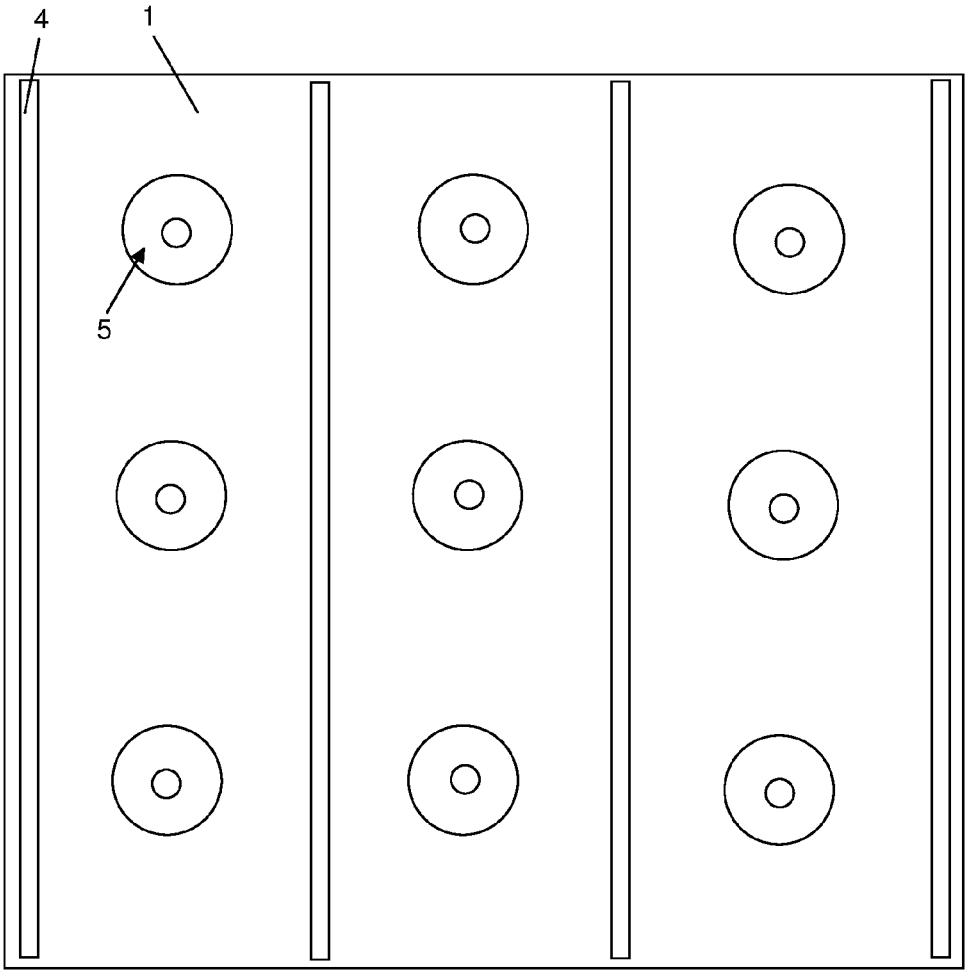
Figure 2

Figure 3
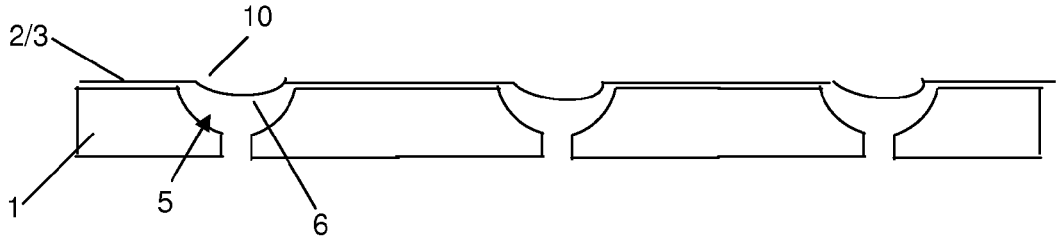
Figure 4
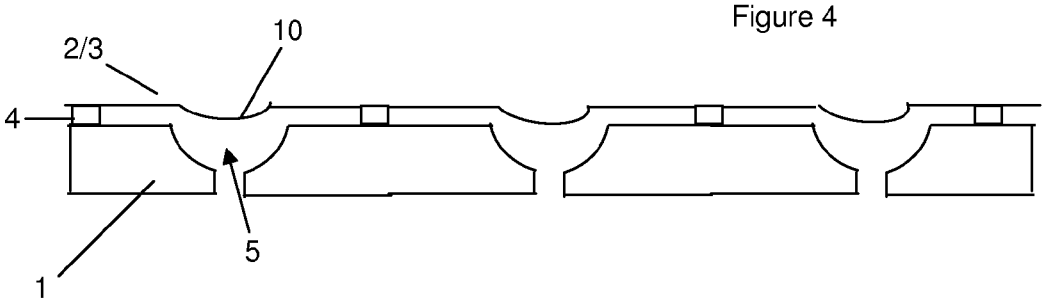
Figure 5
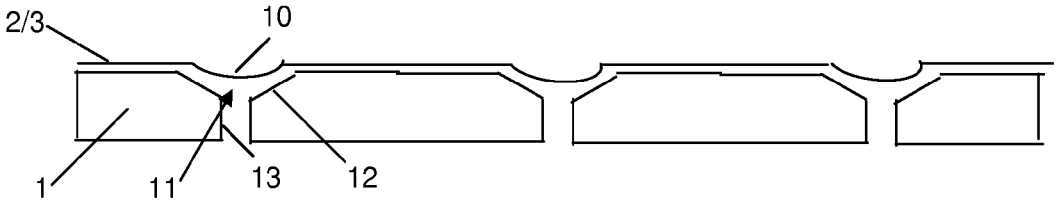
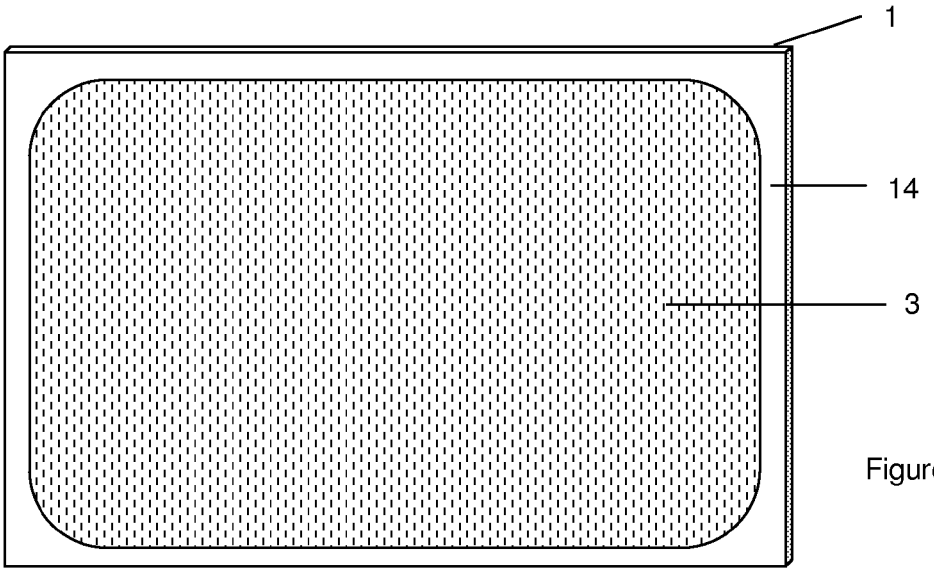
Figure 6

ELECTROSTATIC TRANSDUCER

CROSS-REFERENCE TO RELATED APPLICATIONS

This application is a U.S. National Phase Application pursuant to 35 U.S.C. §371 of International Application No. PCT/GB2012/051130, filed on May 18, 2012, which is incorporated by reference in its entirety and published as WO 2012/156753on Nov. 22, 2012, and which also claims priority to GB 1108373.0, filed on May 19, 2011.

This invention relates to an electrostatic transducer and is particularly but not exclusively concerned with a loudspeaker suitable for reproducing audio signals.

A traditional electrostatic loudspeaker comprises a conductive membrane disposed between two perforated conductive backplates to form a capacitor. A DC bias is applied to the membrane and an AC signal voltage is applied to the two backplates. Voltages of hundreds or even thousands of volts may be required. The signals cause a force to be exerted on the charged membrane, which moves to drive the air on either side of it.

In U.S. Pat. No. 7,095,864, there is disclosed an electrostatic loudspeaker comprising a multilayer panel. An electrically insulating layer is sandwiched between two electrically conducting outer layers. The insulating layer has circular pits on one of its sides. It is said that when a DC bias is applied across the two conducting layers, portions of one of the layers are drawn onto the insulating layer to form small drumskins across the pits. When an AC signal is applied, the drumskins resonate, and parts of that conducting layer vibrate to produce the required sound.

In WO 2007/077438 there is disclosed an further type of electrostatic loudspeaker comprising a multilayer panel. An electrically insulating layer is sandwiched between two electrically conducting outer layers. In this arrangement, one of the outer conducting layers is perforated and, for example, may be a woven wire mesh providing apertures with a size of typically 0.11 mm.

In US 2009/0304212 there is disclosed an electrostatic loudspeaker comprising a conductive backplate provided with an array of vent holes and an array of spacers. Over this is positioned a membrane comprising a dielectric and a conductive film. The space between the backplate and the membrane is about 0.1 mm and it is said that a low voltage supplied to the conductive backplate and the conductive film will push the membrane to produce audio.

One problem with electrostatic loudspeakers of this type is obtaining sufficient displacement of the membrane. In U.S. Pat. No. 7,095,864, for example, the apertures provide room for the "drumskins" to vibrate. However, the electrostatic field strength rapidly falls off towards the centre of the hole.

An object of the present invention is to provide an electrostatic transducer which has improved performance.

Viewed from one aspect, the invention provides an electrostatic transducer comprising an electrically conductive first layer, a flexible insulating second layer disposed over the first layer, and a flexible electrically conductive third layer disposed over the second layer, wherein the first layer is provided with an array of through apertures each having an inlet facing the second layer and an outlet; and in response to signals applied to the first and third layers, the second and third layers have portions which are displaced towards the outlets of the apertures by electrostatic forces; and wherein the first and second layers are separate layers which are bonded together along a series of lines spaced apart across the layers, and/or the second and third layers are separate layers which are bonded together along a series of lines spaced apart across the layers.

In one embodiment of this aspect of the invention, the layers that are bonded together are bonded together by spacers which are adhered to both layers.

Viewed from another aspect, the present invention provides an electrostatic transducer comprising an electrically conductive first layer, a flexible insulating second layer disposed over the first layer, and a flexible electrically conductive third layer disposed over the second layer, wherein the first layer is provided with an array of through apertures each having an inlet facing the second layer and an outlet and, in response to signals applied to the first and third layers, the second and third layers have portions which are displaced towards the outlets of the apertures by electrostatic forces; and wherein the first and second layers are separated by spacers between the first and second layers, and/or the second and third layers are separated by spacers between the second and third layers.

Spacers between the first and second layers allow greater freedom of movement of the second and third layers. It has also been found that spacers between the second and third layers improve performance.

The spacers between two layers could for example be in the form of, preferably parallel, strips positioned between the two layers; or individual spacers—which could be arranged in straight lines but need not be so. A grid of strips or lines of spacers may be provided.

The spacers may be adhered to one layer. Preferably, the spacers are also adhered to the other layer and will form the principal means of joining the two layers together. Preferably, the layers are not joined at positions between the spacers. The spacers could themselves be in the form of portions of adhesive, which can be laid down on one of the layers, and will then serve to attach that layer to the other layer. Thus, strips of adhesive can be laid down which will join the layers together along those strips and which will space the layers apart.

In an alternative arrangement the two layers concerned (the first and the second; and/or the second and the third) are of plastics material and are connected together by heat staking (which in this context is softening of a coating on each layer and forcing them together under pressure) or welding, or solvent bonding so that they are joined together at a number of points, which may be considered as adhesions. These will cause deformations in the layers, which will tend to keep the layers apart. Thus these adhesions serve to space the layers apart and are spacers in that sense, even though at the adhesions the layers may be merged together.

For spacers between the first and second layers, for ease of positioning a strip or arrangement of individual spacers may be positioned in the spaces between the apertures. For ease of positioning, the strips or individual spacers may be placed on the first layer and then the second layer applied.

The spacers between two layers may have a thickness of between about 15 to about 25 microns (0.015 mm to 0.025 mm) , preferably between 20 to 25 microns. However, spacers of other thickness may be used, such as strips or other spacers with a thickness of up to 30 microns, 40 microns, 50 microns, 60 microns, 70 microns, 80 microns, 90 microns 100 microns, 110 microns, 120 microns, 130 microns, 140 microns or 150 microns, for example.

In the case of strips, which may be spacers, or strips of adhesive, or welds, these may have a width of about 0.5 mm or about 1 mm, or about 1.5 mm, or about 2 mm, or about 2.5 mm, or about 3 mm or about 3.5 mm or about 4 mm or about 4.5 mm or about 5 mm. The strips may have a width in the range of about 0.5 mm to about 5 mm, such as about 1 mm to about 2 mm, about 1 mm to about 2.5 mm. about 2 mm to about 3 mm, about 3 mm to about 4 mm or about 3 mm to about 5 mm.

The spacers or adhesive or adhesions such as welds may be in the form of continuous or intermittent strips, or may be in the form of lines of discrete portions such as dots of adhesive or adhesions as described earlier, which are spaced apart laterally by a distance in the range of about 10 mm to about 100 mm, or about 10 mm to about 50 mm, or about 10 mm to about 30 mm, or about 15 mm to about 20 mm.

The spacers may be of a conductive material or an insulating material, such as Mylar™ although, as noted above, an adhesive—preferably an insulating adhesive —is used in some preferred embodiments.

In a preferred embodiment of these aspects of the invention, the apertures in the first layer have walls with inwardly directed portions which have conductive surfaces.

In this manner, as portions of the second and third layers move towards the outlets of the apertures, they move closer to the inwardly directed wall portions of the apertures. As these wall portions are conductive, this enhances the electrostatic force acting on these portions of the electrically conductive third layer. This is an inventive feature in its own right and thus viewed from another aspect, the present invention provides an electrostatic transducer comprising an electrically conductive first layer, a flexible insulating second layer disposed over the first layer, and a flexible electrically conductive third layer disposed over the second layer, wherein the first layer is provided with an array of through apertures each having an inlet facing the second layer and an outlet; characterised in that in response to signals applied to the first and third layers, the second and third layers have portions which are displaced towards the outlets of the apertures by electrostatic forces, and the apertures have walls with inwardly directed portions which have conductive surfaces.

The wall portions may converge towards the aperture outlet. Converging walls may be straight, so as to define an aperture in the shape of a portion of a cone. Alternatively they may be curved, or there may be a combination of curved and straight portions. Adjacent to the outlet of an aperture, there may be a portion where the walls do not converge and there may be a straight bore or conceivably they could diverge in this region. Curved walls could be convex but in a preferred embodiment they are concave.

Alternatively, the aperture may be stepped, for example having a relatively wide portion of generally constant size for a certain depth, and then having an inwardly directed wall portion which is provided with a narrower bore to the outlet of the aperture. In this arrangement, the conductive portions may be provided on the inwardly directed wall portion and optionally also on the side wall of the relatively wide portion.

The inwardly directed portions of the walls may be entirely conductive or may have a number of conductive portions. For example, if the first layer is made from a conductive mesh with small diameter holes, the mesh may be shaped so that if forms flat portions from which depressions descend. In that case both the flat portions and the walls of the apertures would have small diameter holes across their surfaces. However, the opening to one of the depressions would be considerably wider and define the inlet to an aperture in accordance with the invention; and a number of the mesh holes at the base of the depression would constitute the outlet in accordance with the invention (although a separate outlet could be provided, additionally or alternatively).

Preferably the inwardly directed portions of the aperture walls are in electrical communication with the remainder of the first layer. This will naturally be the case if the first layer is formed from a conductive mesh that is shaped to define the apertures, or if the first layer is formed from a sheet of metal that is shaped to define the apertures, or for example if the first layer is moulded from a conductive polymer. In one form of the invention, the first layer is a sheet of a polymeric material which is non conductive and has the apertures formed in it, and then the surface of the first layer, including the walls of the apertures, is provided with a conductive coating.

The shape of the inlet of the apertures, viewed in plan view, may be circular, elliptical or any other chosen shape.

In some embodiment of the invention it is preferred that the apertures are of a considerably larger size than the spaces in a mesh such as is used in WO 2007/077438. For example, in some embodiments the aperture may have a minimum dimension of the inlet of the aperture (which in the case of a circular inlet would be the diameter, or in the case of an elliptical aperture its minor axis) no less than about 0.5 mm.

With apertures of a suitable size, there may be advantageous effects even if the apertures do not have inwardly directed wall portions, provided that the walls are provided with conductive portions. Thus, the apertures may be substantially larger than those that it would be practicable to provide with a mesh such as that in WO 2007/077438, given that a widely spaced mesh would provide a small conductive surface overall. Wide apertures would normally mean a sharp reduction in the electrostatic field towards the centre of the aperture. However, by making the walls of the apertures conductive the field in the region of the apertures may be enhanced.

Thus, viewed from a further aspect of the invention, there is provided an electrostatic transducer comprising an electrically conductive first layer, a flexible insulating second layer disposed over the first layer, and a flexible electrically conductive third layer disposed over the second layer, wherein the first layer is provided with an array of through apertures each having an inlet facing the second layer and an outlet; characterised in that in response to signals applied to the first and third layers, the second and third layers have portions which are displaced towards the outlets of the apertures by electrostatic forces, the apertures have inlets with a minimum dimension of at least about 0.5 mm, and the walls of the apertures have conductive surfaces.

In embodiments of some aspects of the invention, there will be advantageous effects even if the apertures do not have inwardly directed wall portions, and their walls are not provided with conductive portions.

In some embodiments of all aspects of the invention the minimum dimension of the inlet of the aperture (which in the case of a circular inlet would be the diameter, or in the case of an elliptical aperture its minor axis) may be no less than about 0.75 mm, 1 mm, 1.25 mm, 1.5 mm, 1.75 mm, 2 mm, 2.25 mm, 2.5 mm, 2.75 mm, 3 mm, 3.25 mm, 3.5 mm, 3.75 mm, 4 mm, 4.25 mm, 4.5 mm, 4.75 mm, 5 mm, 5.25 mm, 5.5 mm, 5.75 mm, 6 mm, 6.25 mm, 6.5 mm, 6.75 mm, 7 mm, 7.25 mm, 7.5 mm, 10 mm, 11 mm, 12 mm, 13 mm, 14 mm, 15 mm, 16 mm, 17 mm, 18 mm, 19 mm or 20 mm.

In some embodiments of all aspects of the invention the maximum dimension of the inlet of the aperture (which in the case of a circular inlet would be the diameter, or in the case of an elliptical aperture its major axis) may be no greater than about 0.75 mm, 1 mm, 1.25 mm, 1.5 mm, 1.75 mm, 2 mm, 2.25 mm, 2.5 mm, 2.75 mm, 3 mm, 3.25 mm, 3.5 mm, 3.75 mm, 4 mm, 4.25 mm, 4.5 mm, 4.75 mm, 5 mm, 5.25 mm, 5.5 mm, 5.75 mm, 6 mm, 6.25 mm, 6.5 mm, 6.75 mm, 7 mm, 7.25 mm, 7.5 mm, 7.75 mm, 8 mm, 38.25 mm, 8.5 mm, 8.75 mm, 9 mm, 9.25 mm, 9.5 mm, 9.75 mm, 10 mm, 11 mm, 12 mm, 13 mm, 14 mm, 15 mm 16 mm, 17 mm, 18 mm, 19 mm, or 20 mm.

In some embodiments of all aspects of the invention the dimension of the inlet of the aperture may be in a range whose lower figure is chosen from about 0.5 mm 0.75 mm, 1 mm, 1.25 mm, 1.5 mm, 1.75 mm, 2 mm, 2.25 mm, 2.5 mm, 2.75 mm, 3 mm, 3.25 mm, 3.5 mm, 3.75 mm, 4 mm, 4.25 mm, 4.5 mm, 4.75 mm, 5 mm, 5.25 mm, 5.5 mm, 5.75 mm, 6 mm, 6.25 mm, 6.5 mm, 6.75 mm, 7 mm, 7.25 mm, 7.5 mm, 7.75 mm, 8 mm, 38.25 mm, 8.5 mm, 8.75 mm, 9 mm, 9.25 mm, 9.5 mm, 9.75 mm, 10 mm, 11 mm, 12 mm, 13 mm, 14 mm, 15 mm 16 mm, 17 mm, 18 mm, 19 mm or 20 mm; and whose upper figure is a larger figure chosen from about 0.75 mm, 1 mm, 1.25 mm, 1.5 mm, 1.75 mm, 2 mm, 2.25 mm, 2.5 mm, 2.75 mm, 3 mm, 3.25 mm, 3.5 mm, 3.75 mm, 4 mm, 4.25 mm, 4.5 mm, 4.75 mm, 5 mm, 5.25 mm, 5.5 mm, 5.75 mm, 6 mm, 6.25 mm, 6.5 mm, 6.75 mm, 7 mm, 7.25 mm, 7.5 mm, 7.75 mm, 8 mm, 38.25 mm, 8.5 mm, 8.75 mm, 9 mm, 9.25 mm, 9.5 mm, 9.75 mm, 10 mm, 11 mm, 12 mm, 13 mm, 14 mm, 15 mm 16 mm, 17 mm, 18 mm, 19 mm, 20 mm or 25 mm.

In embodiments of all aspects of the invention, the apertures may have all substantially the same inlet dimension, or there may be a combination of two or more dimensions. For example, there could be one region, such as an inner region, which may have apertures of one dimension or range of dimensions, and one or more other regions, such as one or more outer regions with apertures of another dimension or range of dimensions. Within a region there may be a mixture of apertures of two or more different dimensions The depth of the apertures will match the thickness of the first layer. The thickness of the first layer could be in a range whose lower figure is chosen from about 0.5 mm 0.75 mm, 1 mm, 1.25 mm, 1.5 mm, 1.75 mm, 2 mm, 2.25 mm, 2.5 mm, 2.75 mm, 3 mm, 3.25 mm, 3.5 mm, 3.75 mm, 4 mm, 4.25 mm, 4.5 mm, 4.75 mm, 5 mm, 5.25 mm, 5.5 mm, 5.75 mm, 6 mm, 6.25 mm, 6.5 mm, 6.75 mm, 7 mm, 7.25 mm, 7.5 mm, 7.75 mm, 8 mm, 38.25 mm, 8.5 mm, 8.75 mm, 9 mm, 9.25 mm, 9.5 mm, 9.75 mm or about 10 mm; and whose upper figure is a larger figure chosen from about 0.75 mm, 1 mm, 1.25 mm, 1.5 mm, 1.75 mm, 2 mm, 2.25 mm, 2.5 mm, 2.75 mm, 3 mm, 3.25 mm, 3.5 mm, 3.75 mm, 4 mm, 4.25 mm, 4.5 mm, 4.75 mm, 5 mm, 5.25 mm, 5.5 mm, 5.75 mm, 6 mm, 6.25 mm, 6.5 mm, 6.75 mm, 7 mm, 7.25 mm, 7.5 mm, 7.75 mm, 8 mm, 38.25 mm, 8.5 mm, 8.75 mm, 9 mm, 9.25 mm, 9.5 mm, 9.75 mm, 10 mm, 11 mm, 12 mm, 13 mm, 14 mm or about 15 mm.

In embodiments with apertures with converging wall portions, the convergent region of the apertures may occupy less than the thickness of the first layer and terminate in a simple bore.

The convergent region of the apertures, or in the case of stepped apertures the region before the step, could occupy a depth in a range whose lower figure is chosen from about 0.5 mm 0.75 mm, 1 mm, 1.25 mm, 1.5 mm, 1.75 mm, 2 mm, 2.25 mm, 2.5 mm, 2.75 mm, 3 mm, 3.25 mm, 3.5 mm, 3.75 mm, 4 mm, 4.25 mm, 4.5 mm, 4.75 mm, 5 mm, 5.25 mm, 5.5 mm, 5.75 mm, 6 mm, 6.25 mm, 6.5 mm, 6.75 mm, 7 mm, 7.25 mm, 7.5 mm, 7.75 mm, 8 mm, 38.25 mm, 8.5 mm, 8.75 mm, 9 mm, 9.25 mm, 9.5 mm, 9.75 mm or about 10 mm; and whose upper figure is a larger figure chosen from about 0.75 mm, 1 mm, 1.25 mm, 1.5 mm, 1.75 mm, 2 mm, 2.25 mm, 2.5 mm, 2.75 mm, 3 mm, 3.25 mm, 3.5 mm, 3.75 mm, 4 mm, 4.25 mm, 4.5 mm, 4.75 mm, 5 mm, 5.25 mm, 5.5 mm, 5.75 mm, 6 mm, 6.25 mm, 6.5 mm, 6.75 mm, 7 mm, 7.25 mm, 7.5 mm, 7.75 mm, 8 mm, 38.25 mm, 8.5 mm, 8.75 mm, 9 mm, 9.25 mm, 9.5 mm, 9.75 mm, 10 mm, 11 mm, 12 mm, 13 mm, 14 mm or about 15 mm.

In some arrangements in accordance with all aspects of the invention the second layer is attached to the first layer at spaced positions, for example by means of adhesive. In some arrangements the second layer is free from attachment to the first layer. In some arrangements the second layer is free from attachment to the first layer over substantially all of the area of the second layer. In some arrangements the second layer is free from attachment to the first layer over at least a major part of the area of the second layer. In some arrangements, spacers are provided between the first and second layers. In some arrangements, adhesive acts as spacers.

In some arrangements in accordance with all aspects of the invention, the second layer is attached to the third layer at spaced positions, for example by means of adhesive or adhesions. In some arrangements the second layer is free from attachment to the third layer. In some arrangements the second layer is free from attachment to the third layer over substantially all of the area of the second layer. In some arrangements the second layer is free from attachment to the third layer over at least a major part of the area of the second layer. In some arrangements, spacers are provided between the second and third layers. In some arrangements, adhesive acts as spacers.

In some arrangements in accordance with the second and third aspects of the invention, the third layer is not separate from the second layer, but formed by a conductive layer applied to the side of the second layer facing away from the first layer. For example, the second layer may comprise an insulating polymer film which has been metalized on one side.

The first layer may be rigid, semi rigid or flexible. It may for example be of a polymer sheet to which a conductive layer has been applied.

Viewed from another aspect, the invention provides an electrostatic transducer comprising an electrically conductive first layer, a flexible insulating second layer disposed over the first layer, and a flexible electrically conductive third layer disposed over the second layer, wherein the first layer is provided with an array of through apertures each having an inlet facing the second layer and an outlet; and in response to signals applied to the first and third layers, the second and third layers have portions which are displaced towards the outlets of the apertures by electrostatic forces; and wherein the first and second layers, and/or the second and third layers, are separate layers which are bonded together along a series of, preferably parallel, lines spaced across the layers and are not joined together between those lines.

In some embodiments the layers may be bonded together by spacers which are adhered to both layers. The spacers may be in the form of continuous or intermittent strips extending along the lines, or discrete spacers at intervals along the lines. In some embodiments, the layers may be bonded together by adhesive which joins the layers together and which may or may not have a spacing effect. The adhesive may be in the form of continuous or intermittent strips of adhesive extending along the lines, or discrete patches of adhesive at intervals along the lines. In some embodiments the two layers to be bonded together are both of polymeric material and are welded together by, for example, heat, ultrasonic or solvent welding. The method of welding may or may not provide a spacing effect. The welds may be continuous or intermittent, extending along the lines, or discrete welds at intervals along the lines.

Viewed from another aspect, the invention provides an electrostatic transducer comprising an electrically conductive first layer, a flexible insulating second layer disposed over the first layer, and a flexible electrically conductive third layer disposed over the second layer, wherein the first layer is provided with an array of through apertures each having an inlet facing the second layer and an outlet; and in response to signals applied to the first and third layers, the second and third layers have portions which are displaced towards the outlets of the apertures by electrostatic forces; and wherein the first and second layers, and/or the second and third layers, are separate layers which are bonded together along a series of, preferably parallel, lines spaced across the layers and are spaced apart between those lines.

The details of construction of embodiments of any aspect of the invention may also be used in conjunction with any other aspect of the invention.

In use of a transducer as set out above as a loudspeaker, a bias voltage may be applied across the first and third layers, and an alternating signal voltage also across those layers. The voltages could be of any desired value, depending on loudspeaker size, total harmonic distortion specified and the output required.

An embodiment of the invention will now be described by way of example and with reference to the accompanying drawings, in which:

FIG. 1 is a diagrammatic section through a transducer in accordance with one embodiment of the invention;

FIG. 2 is a plan view of part of the transducer;

FIG. 3 is a diagram showing deflection of components of the transducer in one embodiment;

FIG. 4 is a diagram showing deflection of components of the transducer in another embodiment;

FIG. 5 shows an alternative arrangement to that of FIG. 1;

FIG. 6 is a diagrammatic view of a complete loudspeaker in accordance with the invention;

Figure 7:
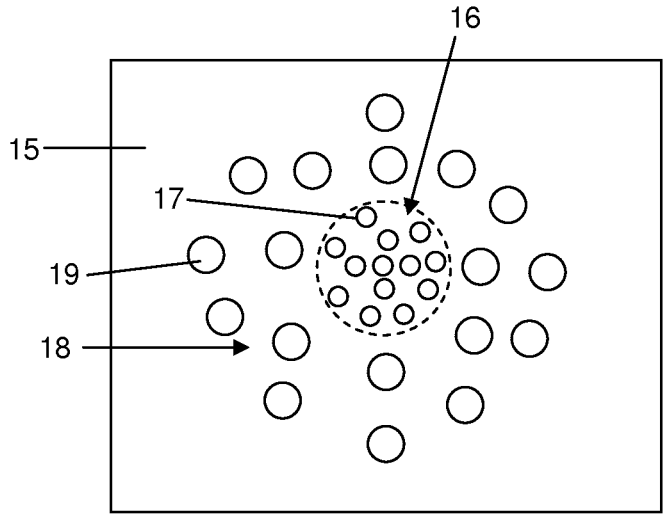
FIG. 7 is a diagrammatic view showing, by way of example only, one possible arrangement of apertures in an embodiment of the invention.

As shown in FIG. 1 loudspeaker comprises a first layer, or backplane, 1 with a thickness of about 3 mm. This is made of an insulating polymer which has been provided with a conductive layer (not shown) on its upper surface. Over this layer is a flexible layer of an insulating polymer film 2, and over that is a conductive layer 3. The conductive layer 3 and the insulating layer 2 could be separate layers but in this embodiment is conductive layer 3 is in the form of metallization applied to the outer surface of insulating layer 2 to provide a film with a total thickness of about 12 microns although in some embodiments film thicknesses of about 6 microns may be used. Insulating strips 4 of Mylar™ are positioned between layers 1 and 2. These strips are between 1 and 2 mm wide, and between about 20 and 25 microns thick.

The backplane 1 is provided with an array of through apertures 5. Each of these has an inlet 6 facing the insulating layer 2, and an outlet 7. The upper part 8 of each aperture is curved and concave and thus provides converging walls. This upper part 8 is also provided with a conductive layer which is connected to the layer on the upper surface of the backplane. The lower part of the aperture is in the form of a simple, parallel sided, bore 9. In this embodiment the aperture inlets are circular with a diameter of 12 mm.

As can be seen from FIG. 2, the insulating strips are provided between the apertures 5.

The drawings are not to scale, and only a portion of a transducer is illustrated so as to explain the principles involved.

In one arrangement in accordance with this embodiment there is a regular array of circular apertures.

With reference to FIG. 3, a DC bias voltage of say 200 to 400 volts can be applied between the conductive portions of the backplane 1 and the outer layer 3. An alternating signal of about 200 volts is also applied across the backplanes 1 and the outer layer 3. The effect is that the film which provides layers 2 and 3 moves towards and away from the backplane as a result of electrostatic forces. In areas over the apertures 5, the film 2/3 can form bulges 10. As shown they project towards the backplane 1, in the region of apertures 5, but they can also project away from the backplane. In this embodiment, when projecting towards the film the bulges 10 can project into the apertures 5.

In the embodiment of FIG. 4, insulating spacer strips 4 are used and whilst bulges form on the film 2/3 projecting towards and away from the backplane, in this embodiment when projecting towards the backplane they do not project into the apertures 5. However, in another embodiment even with the use of spacers the bulges may project into the apertures.

In the embodiment of FIG. 5, the backplane 1 is provided with modified apertures 11. These have straight converging walls 12, which provide a shallower converging part of the aperture. The walls 12 are conductive. The lower part 13 leading to the outlet of the aperture is therefore longer than in the previous arrangements.

FIG. 6 shows a loudspeaker incorporating the invention. The back plane 1 is overlaid with the insulating and conductive layers 2/3—which in this case are a provided by a single sheet of metalized polymer film—and a frame 14 is provided to keep these layers relatively taut over the apertured backplane. The whole assembly may be about 3 mm thick. In alternative arrangements, the backplane may be more flexible and the assembly will be thinner.

FIG. 7 shows a modified backplane 15 which is provided with an inner region 16 with apertures 17 of a relatively small size, and an outer region 18 with apertures 19 of a relatively large size. With such an arrangement the frequency responses or other characteristics of the two regions could be different, making one region more suitable for low or high frequencies than the other.

Figure 8:
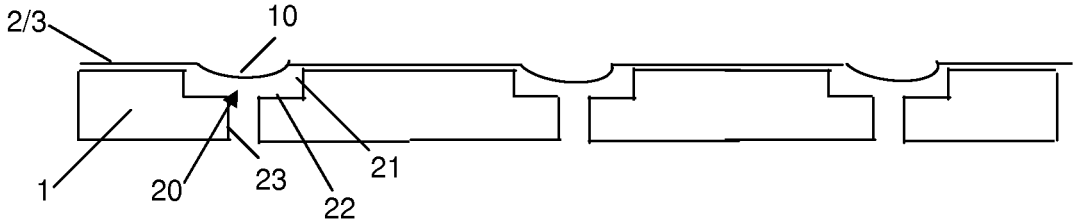
FIG. 8 shows an alternative arrangement to those of FIGS. 1 and 5.

FIG. 8 shows a further embodiment in which the backplane 1 is provided with modified apertures 20. These have an upper portion with straight side wall 21, which terminates in an inwardly directed step 22. A lower part 23 leads to the outlet of the aperture. At least the step 22 is conductive, and preferably the upper portion side wall 21.

Figure 9:
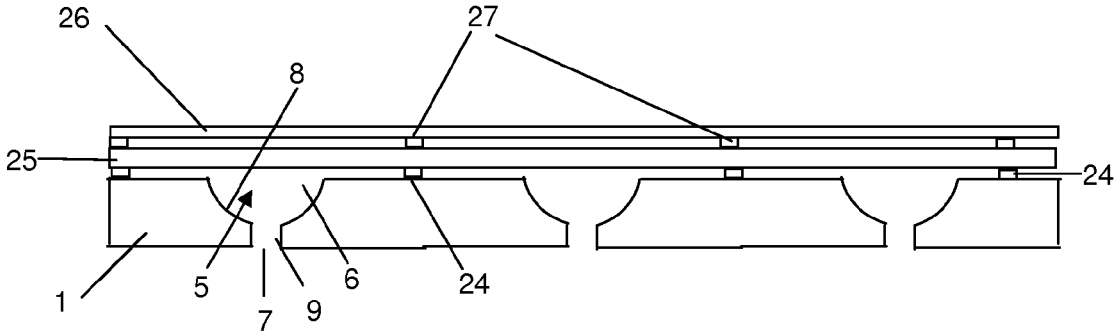
FIG. 9 shows an alternative arrangement for the second and third layers.

FIG. 9 shows a modification of the embodiment of FIG. 1. In this modified embodiment, the spacing strips 4 between the first and second layers 1 have been replaced by strips of adhesive 24 which join the two layers together at laterally spaced intervals and also serve to space the layers apart. Furthermore, the combined second and third layers have been replaced by a separate second layer 25 and third layer 26, separated by strips of adhesive 27 which join the two layers together at laterally spaced intervals and also serve to space the layers apart.

Figure 10:
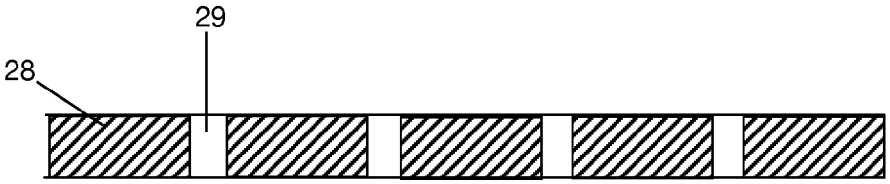
FIG. 10 shows an alternative construction for the first layer.

FIG. 10 shows an alternative first layer, for example for use in the embodiment of FIG. 9. This is in the form of a plate 28 with an array of simple apertures 29. This could be of metal or of a polymer which has been coated with a metallic layer. If coating takes place before the apertures are formed, for example by electro-plating, the apertures will not have conductive walls. However, in embodiments with spacers between layers, there will still be improved performance over the prior art.

Figure 11:
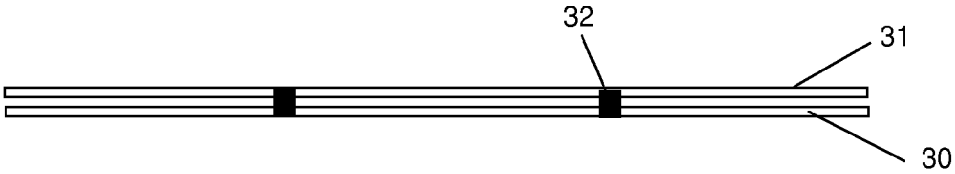
FIG. 11 shows a further alternative arrangement for the second and third layers.

FIG. 11 shows a further alternative arrangement for the second and third layers. There is a separate second layer 30 and a separate third layer 31. These are bonded together along spaced lines 32, for example by welding. Between the weld lines, the layers are spaced apart.

The preferred embodiments of the invention provide a compact, inexpensive thin loudspeaker with improved audio performance.

The invention claimed is:

1. An electrostatic transducer comprising an electrically conductive first layer, a flexible insulating second layer disposed over the first layer, and a flexible electrically conductive third layer disposed over the second layer, wherein the first layer is provided with an array of through apertures each having an inlet facing the second layer and an outlet; and in response to signals applied to the first and third layers, the second and third layers have portions which are displaced towards the outlets of the apertures by electrostatic forces; and wherein the second and third layers are separate layers which are bonded together along a series of lines spaced apart across the layers.

2. The electrostatic transducer of claim 1, wherein the layers that are bonded together are bonded together by spacers which are adhered to both layers.

3. The electrostatic transducer of claim 2, wherein the spacers comprise continuous or intermittent strips extending along the lines, or are discrete spacers at intervals along the lines.

4. The electrostatic transducer of claim 1, wherein the layers that are bonded together are bonded together by adhesive which joins the layers together.

5. The electrostatic transducer of claim 4, wherein the adhesive has an effect of spacing the layers apart.

6. The electrostatic transducer of claim 4, wherein the adhesive comprises continuous or intermittent strips of adhesive extending along the lines, or the adhesive comprises discrete patches of adhesive at intervals along the lines.

7. The electrostatic transducer of claim 1, wherein layers which are bonded together are both of polymeric material and are bonded together by welds along the lines.

8. The electrostatic transducer of claim 7, wherein the welds are heat, ultrasonic or solvent welds.

9. The electrostatic transducer of claim 7, wherein the welds have an effect of spacing the layers apart between the welds.

10. The electrostatic transducer of claim 7, wherein the welds comprise continuous or intermittent welds extending along the lines, or the welds comprise discrete welds at intervals along the lines.

11. The electrostatic transducer of claim 1, wherein the series of lines comprises a series of parallel lines.

12. The electrostatic transducer of claim 1, wherein the separate layers which are bonded together along a series of lines are spaced apart between those lines.

13. The electrostatic transducer of claim 1, wherein the separate layers which are bonded together along a series of lines are not joined together between those lines.

14. The electrostatic transducer of claim 1, wherein the apertures of the first layer have inlets with a minimum dimension of at least about 0.5 mm.

15. The electrostatic transducer of claim 1, wherein the walls of the apertures have conductive surfaces.

16. The electrostatic transducer of claim 15, wherein the conductive surfaces of the apertures are integral with an electrically conductive layer on the surface of the first layer facing the second layer.

17. The electrostatic transducer of claim 1, wherein the second and third layers are held taut.

18. The electrostatic transducer of claim 1, wherein the first and second layers are separate layers which are bonded together along a series of lines spaced apart across the layers, the second layer is a film of polymer and the third layer comprises a conductive surface layer applied to a side of the film remote from the first layer.

* * * * *